US006484916B1

(12) United States Patent
Salom et al.

(10) Patent No.: US 6,484,916 B1
(45) Date of Patent: Nov. 26, 2002

(54) KNAPSACK HAVING A ONE-PIECE SHOULDER-BLADE PAD ELEMENT

(75) Inventors: Olivier Salom, Puisserguiers (FR); David Boulange, Le Buquet Elbeuf (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 09/807,071

(22) PCT Filed: Sep. 10, 1999

(86) PCT No.: PCT/FR99/02163

§ 371 (c)(1),
(2), (4) Date: Jul. 10, 2001

(87) PCT Pub. No.: WO00/19863

PCT Pub. Date: Apr. 13, 2000

(30) Foreign Application Priority Data

Oct. 7, 1998 (FR) ..... 98 12707

(51) Int. Cl.[7] ..... A45F 3/04
(52) U.S. Cl. ..... 224/628; 224/637; 224/907
(58) Field of Search ..... 224/628, 630, 224/631, 637, 641, 907, 627

(56) References Cited

U.S. PATENT DOCUMENTS 2,760,699 A * 8/1956 Rivers-Macpherson ..... 224/201
5,131,576 A * 7/1992 Turnipseed ..... 224/262
5,240,159 A * 8/1993 Gregory ..... 224/264
5,361,955 A * 11/1994 Gregory ..... 224/630
5,725,139 A * 3/1998 Smith ..... 224/631
5,730,347 A * 3/1998 Finot ..... 224/628
5,954,253 A * 9/1999 Swetish ..... 224/628
5,984,157 A * 11/1999 Swetish ..... 224/631
6,179,188 B1 * 1/2001 Gleason ..... 224/262
6,325,262 B1 * 12/2001 Thompson ..... 224/153
6,332,566 B1 * 12/2001 Rota ..... 224/153

FOREIGN PATENT DOCUMENTS

EP 0 122 764 A 10/1984
EP 0 209 381 A 1/1987
EP 0 570 193 A 11/1993
WO WO 91/05495 A 5/1991

* cited by examiner

*Primary Examiner*—Stephen K. Cronin
(74) *Attorney, Agent, or Firm*—Weingarten, Schurgin, Gagnebin & Lebovici LLP

(57) ABSTRACT

The knapsack of the invention comprises a one-piece shoulder-blade pad element (2) whose base for bearing against the back (13) of the knapsack (1) is constituted by a reinforcing plate which has a central zone (3) fixed to the back (13) of the knapsack in the top middle portion thereof, and two side zones (4) of oblong shape which extend the central zone (3) symmetrically both sideways and obliquely downwards. Shoulder-blade pads (8) are placed in the two side zones (4) on the reinforcing plate so as to bear against the back of the user over the shoulder blades. Shoulder straps (9) are fixed to the top edges (12) of the one-piece shoulder-blade pad element (2) in its two side zones (4).

14 Claims, 2 Drawing Sheets

KNAPSACK HAVING A ONE-PIECE SHOULDER-BLADE PAD ELEMENT

The present invention relates to a knapsack with a particular structure for bearing against the back to provide the user with better comfort and the knapsack with better stability.

A knapsack comprises a bag and carrier means including shoulder straps and a belt. When the knapsack is in use, it is the posterior face of the bag, referred to herein as the "back" of the bag, which comes into contact with the back of the user. The shoulder straps are fixed to the top of the back of the knapsack either directly to the material constituting said back or optionally to a central device enabling the height of said straps to be adjusted, as described in document FR 2 668 345.

The weight of the knapsack is supported in part by the zone where the straps bear against the shoulders, and special means are implemented for distributing load via the belt. Although it is possible to provide padding between the shoulder strap and the shoulder, the Applicant finds that does not provide the user with a desirable amount of comfort.

Proposals have already been made in document EP 0 122 764 to improve back comfort by fitting the knapsack with shoulder-blade pads which are longitudinal sleeves filled with padding and slidably mounted on two vertical rods which form the stiffening structure of the knapsack. The shoulder straps connect the two shoulder-blade pads to the bag.

The knapsack of document EP 0 122 764 does indeed improve user comfort to some extent, however it requires a special knapsack-stiffening structure with two vertical rods.

The object of the present invention is to provide comfort that is further improved without requiring such a knapsack-stiffening structure.

This object is fully achieved by the knapsack of the invention which comprises, in the manner disclosed in document EP 0 122 764, a bag, two shoulder-blade pads, and two shoulder straps connecting the two shoulder-blade pads to the bag.

In characteristic manner, it comprises:

a) by a one-piece shoulder-blade pad element comprising a reinforcing plate having a central zone and two side zones extending the sides of the central zone symmetrically about the midplane of the knapsack;

b) in that the shoulder-blade pads are disposed in the two side zones on the reinforcing plate and are shaped to bear against the shoulder blades of the user; and c) in that the reinforcing plate is secured to the back of the knapsack solely via the central zone in the top middle portion of the back.

Thus, by means of the special configuration of the invention, when the knapsack is in use, it is supported near the top of the back not only via the shoulder straps themselves, but also via two shoulder-blade pads, with the load being distributed uniformly over the two shoulder blades by means of the reinforcing plate, even though the knapsack is secured solely via the central zone.

In a preferred embodiment, the connection between the one-piece shoulder-blade pad element and the knapsack is provided with the ability to allow the one-piece element to pivot to a certain extent relative to said back about an axis perpendicular to said back. This ability to pivot provides a degree of independence between the natural movements of the user's body and those of the bag.

In a variant where the back of the knapsack is made of a flexible material, the central zone of the one-piece shoulder pad element (including its reinforcing plate) is entirely secured to said material, e.g. by stitches, or by self-gripping mechanical attachment elements of the hook-and-loop type, with the ability to pivot being obtained by the ability of said material to deform about the connection zone. Under such circumstances, the back of the knapsack preferably includes at least one stiffening element at a short distance above the connection zone. By means of this stiffening element, which can be located at a distance d of about 1 centimeter (cm) for example, the angular extent of the pivoting is limited. This stiffening element can consist in particular in a strap sewn transversely to the cloth constituting the back of the knapsack, said strap serving as a connection point for a handle for taking hold of the knapsack.

In order to further improve application of the two shoulder-blade pads against the user's shoulder blades, the reinforcing plate is slightly curved so that the side zones are spaced a little apart from the back of the knapsack when in use, thereby allowing for a certain amount of air flow. When the knapsack is full it is generally of a bulging shape which is curved in the opposite direction to the natural curvature of user's back. The particular configuration of the one-piece shoulder-blade pad element conforms completely with these differences of curvature.

In an embodiment, the reinforcing plate is made of a material that is rigid or semi-rigid, e.g. a high density foam which is covered in the two side zones by an aerated and damping material constituting the padding of the shoulder-blade pads, e.g. a superposition of a medium density foam and a porous foam that allows air to flow.

The present invention will be better understood on reading the following description of two embodiments of a knapsack having a one-piece shoulder-blade pad, as shown in the accompanying drawings, in which.

Figure 1:
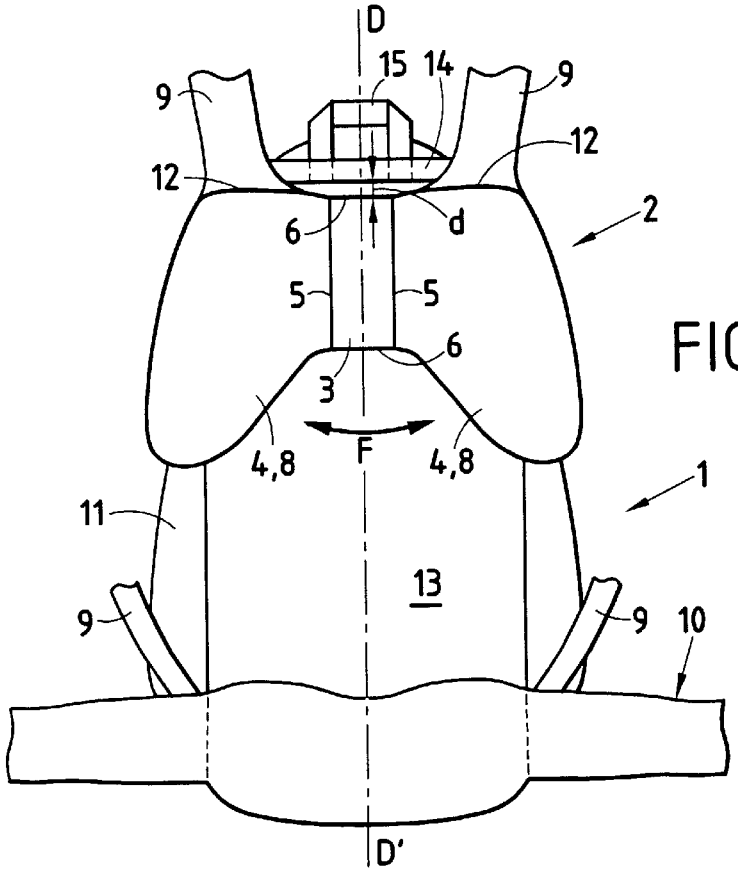
FIG. 1 is a view showing the back of a first embodiment of a knapsack.

With reference to FIG. 1, the knapsack 1 of the invention is characterized by the presence of a one-piece shoulder-blade pad element 2 which alone provides back support while the knapsack 1 is being worn, even though it is fixed thereto in a central zone only.

The one-piece element 2 has three distinct zones, namely: a central zone 3 and two side zones 4 which are symmetrical about a plane containing the middle axis DD' of the element 2 and also of the knapsack 1.

By way of non-exclusive example, the central zone 3 is rectangular in shape with its long sides extending in the vertical direction of the knapsack, parallel to the axis DD', while its short sides 6 extend across the width of the knapsack, perpendicular to the axis DD'.

Each of the side zones 4 is designed to bear against one of the shoulder blades of the user while the knapsack is being worn. In the first embodiment shown in FIG. 1, each of the two side zones 4 is oblong in shape extending sideways from the central zone and obliquely towards the bottom of the knapsack.

A reinforcing plate 7 (visible in FIG. 2) constitutes the basis of the one-piece element 2, said plate extending both in the central zone 3 and in the two side zones 4, and giving the above-mentioned special shape to said one-piece assembly.

A pad 8 is placed in each side zone 4 increasing the thickness of the reinforcing plate 7 and designed to come into contact with the user's back while the knapsack is being worn.

In conventional manner, the knapsack 1 has two shoulder straps 9 and a belt 10. The shoulder straps 9 are not fixed to the bag 11 but to the one-piece shoulder pad element 2 via the top edges 12 of the side zones 4. In the example shown (which is for the European market), this connection is made as far away as possible from the central zone 3. The position of this connection can vary depending on the average morphology-of users.

The opposite ends of the shoulder straps 9 are secured to low portions of the knapsack, close to the belt 10.

The bag 11 is secured to the one-piece shoulder-blade pad element 2 via the central zone 3 of said element 2. This connection is preferably made so as to provide the element 2 with the ability to pivot to some extent relative to the back 13 of the knapsack, as shown by arrow F.

When the back 13 of the knapsack is made of a flexible material, in particular a cloth, this ability to pivot is obtained very simply by stitches or any other fastening means between all or part of the zone 3 of the one-piece element 2 and said material constituting the back 13. The pivoting is then made possible by natural deformation of the flexible material.

Nevertheless, in order to limit this deformation, it is preferable to stiffen the back portion 13 that lies in the vicinity of the connection zone, as in the example shown. By way of example, stiffening can be provided by a strap 14 sewn transversely to the top of the back 13 at a small distance from and parallel to the top short side 6 of the central zone 3. This strap can be used to secure a handle 15 for carrying the knapsack 1. Deformation of the flexible material above the connection zone is thus smaller than its deformation beneath the connection zone so as to obtain smaller angular displacement in the vicinity of the stiffening element 14, which displacement is preferably centered on the axis DD'.

Figure 2:
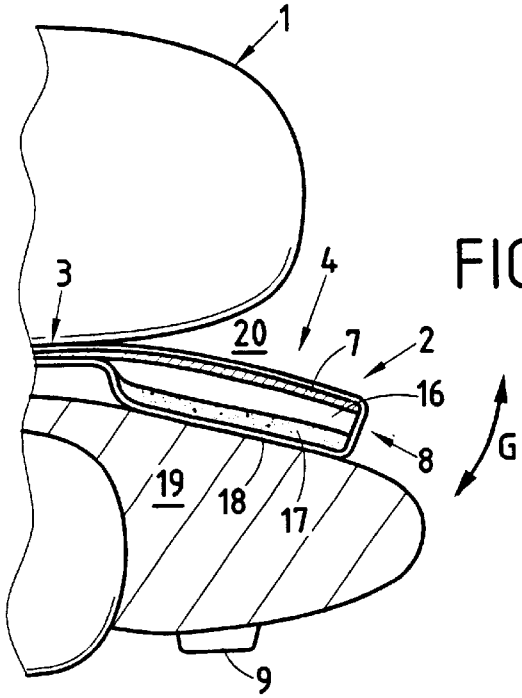
FIG. 2 is a fragmentary diagrammatic view of the first embodiment of the knapsack as seen from above, showing the one-piece element in section through a shoulder-blade pad when on the back of the user.

As shown in FIG. 2, the reinforcing plate 7 is preferably curved, at least in the two side zones 4 so that the one-piece element 2 substantially matches the natural curvature of the back and so that the shoulder-blade pads 8 make uniform contact over their entire surface area with the back of the user via the shoulder blades.

The shoulder-blade pads 8 are padded with foam that increases the thickness of the reinforcing plate 7. This can comprise a superposed plurality of layers of foams of different structures, e.g. a first layer 16 of medium density foam that is in contact with the reinforcing plate 7, and a second layer 17 of low density foam with open pores.

The reinforcing plate 7 and the layers of foam 16, 17 are placed inside a cover 18, with the entire assembly constituting the one-piece shoulder-blade pad element 2. The cover 18 is preferably perforated over the second layer of foam 17 so as to allow air to pass through, thereby ventilating the shoulder-blade pads to some extent and removing the sweat that they can absorb while the knapsack is being worn.

The reinforcing plate 7 must be sufficiently rigid firstly to transfer load between the central zone secured to the back of the knapsack and the shoulder straps fixed to the side zones, and secondly to allow the one-piece assembly 2 to pivot uniformly relative to the knapsack. However there is no need for it to be completely rigid, and it can flex to a small extent as shown by arrow G.

FIG. 2 shows the position of the one-piece element 2 while the knapsack 1 is being worn. The user's back is contacted solely through the side zones 4 of the one-piece element 2, with the curvature of the reinforcing plate 7 making it possible for back contact to be distributed uniformly over this entire area. It can be observed that the knapsack 1, when full, takes up a bulging shape which curves in the opposite direction to the curved shape of the user's back 19, so that an empty space 20 is left between the knapsack and the one-piece element 2 on either side of the connection zone 2, thus enabling the wearer's back to be ventilated by a flow of air.

The maximum weight of the one-piece element 2 can be greater than the width of the back 13 of the knapsack, particularly with a small-volume knapsack.

The central zone 3 is secured to the back 13 of the knapsack 1 by stitching along the four sides 5, 6 of the central zone 3 and also along the two diagonals of the corresponding rectangle. Such connection by stitching is easily implemented along the two small sides 6 of the cover 18. Along the two long sides and along the diagonals, it is necessary also to stitch through the reinforcing plate. This can be done by using a plate made out of high or medium density foam while nevertheless ensuring that it is sufficiently rigid to obtain the desired technical effect.

Figure 3:
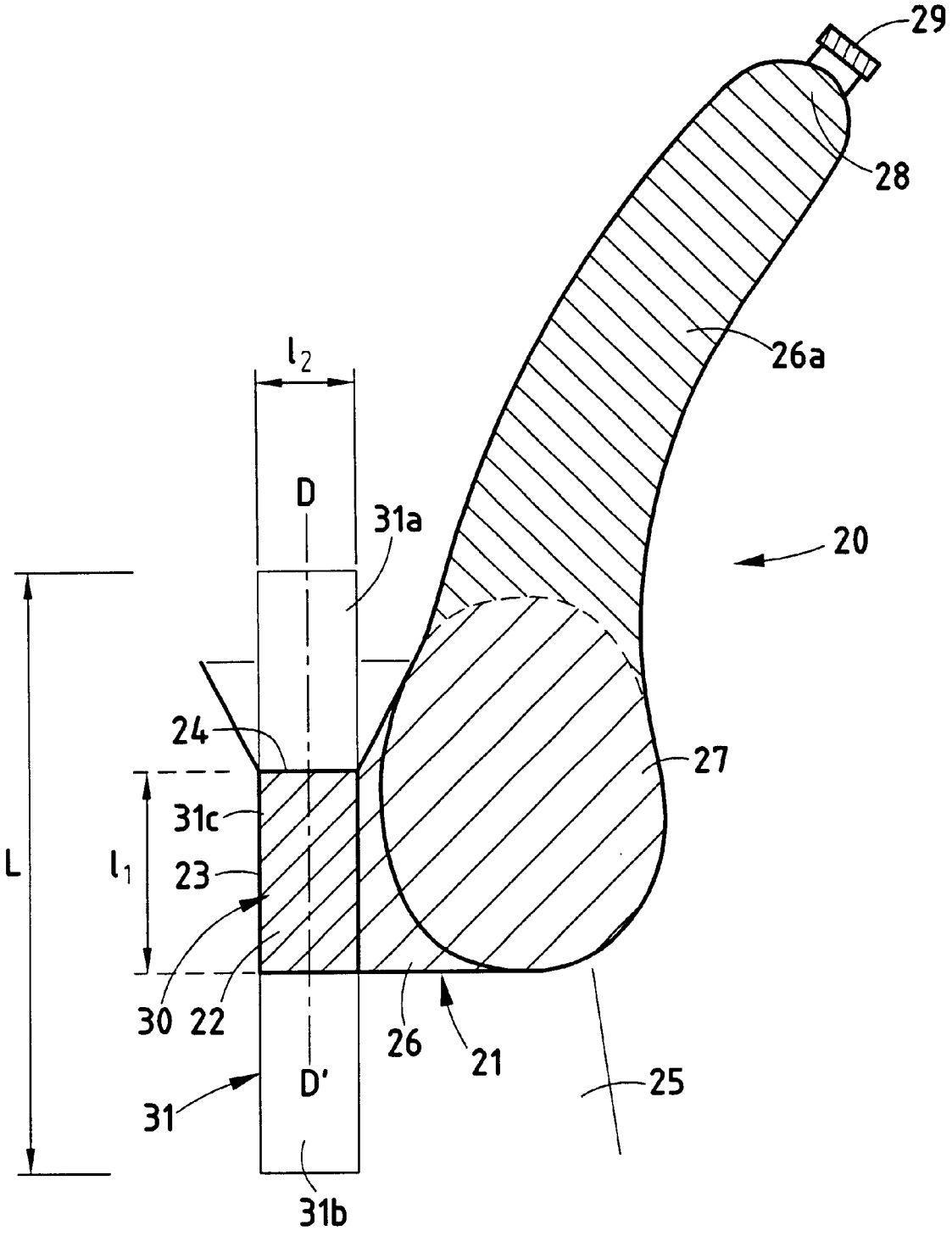
FIG. 3 is a fragmentary diagrammatic view of the back of a second embodiment of the knapsack.

The second embodiment of a knapsack 20 of the invention is shown in part in FIG. 3 which relates essentially to a one-piece shoulder-blade pad element 21 of a configuration that is different from that of the first embodiment. As before, this one-piece element 21 has a central portion 22 of rectangular shape with its long sides 23 extending longitudinally along the middle axis DD' of the knapsack while its two short sides 24 extend across said axis DD'. In a preferred embodiment, the central zone 22 via which the one-piece element 21 is secured to the back 25 of the knapsack 20 has long sides 23 that are about 8 cm to 12 cm long, and short sides 24 that are about 4 cm to 6 cm long.

The side zones 26 of the one-piece element 21 extend on either side of the central zone 22 and they project towards the top of the knapsack, with the end portion **26*a*** of each projection acting as a shoulder strap.

In each side zone 26, the shoulder-blade pad 27 has an oblong shape which extends over the side zone 26, including into the upward projection thereof up to the end portion **26*a***.

The reinforcing plate extends over the entire area of the one-piece element 21, including within the end portions **26*a* that form shoulder straps. Towards the tip 28 of each end portion 26*a* there is provided a buckle 29 for receiving a strap suitable for connecting the one-piece element 21 to the bottom portion of the bag. The end portions 26*a*** can also be padded.

In the embodiment shown in FIG. 3, the one-piece shoulder-blade pad element 21 is secured to the back 25 of the knapsack 20 by mechanical fastener elements of the self-fastening type, using hooks and loops. More particularly, the central zone 22 of the one-piece element 21 has loop elements on the outside, provided in particular by sewing a strip of cloth 30 having loops both on the outside face and on the inside face to the central zone 22 of the outer covering of the one-piece element 21.

Furthermore, in the top middle portion of the back 25 of the knapsack that corresponds to the zone for securing said back 25 to the one-piece element 21, there are provided elements that have hooks. In the example shown in FIG. 3, this comprises a strip 31 of length L that is substantially three times longer than the long side 23 of length $\mathbf{1}_1$ of the central rectangular zone 22. The strip 31 does, however, have the same width $\mathbf{1}_2$ as the short side 24 of the central zone 22. This strip 31 presents hooks on its outside face and loops on its inside face, and it is sewn onto the back 25 of the knapsack solely in its middle portion 31*c* that corresponds to the surface of the central zone 22. The two ends 31*a* and 31*b* of this strip 31 that are not sewn to the back 25 of the knapsack are therefore free.

The one-piece shoulder-blade pad element 21 is secured to the knapsack by pressing its central zone 22 against the sewn middle portion 31*c* of the strip 31 so that the loops on the inside face of the central zone 22 co-operate with the hooks carried by the middle portion 31*c* of the strip 31.

The bottom end 31*b* of the strip 31 is raised towards the central zone 22 so that the hooks carried by this end 31*b* co-operate with the outside loops carried by the strip 30 covering the central zone 22. Thereafter the top end 31*a* is moved down in turn to cover the bottom end 31*b*. Since the strip 31 has loops on its inside face, the hooks carried by the top end 31*a* co-operate with said loops, thereby locking the central zone 22 of the one-piece shoulder-blade pad element 21 definitively in position on the back 25 of the knapsack 20. This element can be removed by performing the same operations in the opposite order.

This method of connection means that the one-piece shoulder-blade pad element is not definitively secured to the bag, thus making it possible when the knapsack is sold to give the user the opportunity to assemble a desired knapsack by selecting a best-fit one-piece shoulder-blade pad element and by selecting the desired type of bag.

The present invention is not limited to the preferred embodiment described above by way of non-exhaustive example. In particular, the way the central portion 3 of the one-piece shoulder-blade pad element 2 is secured with the ability to pivot can be obtained by other means, optionally using intermediate fastening pieces that provide for angular movement.

The term "one-piece" as used herein merely means that the shoulder-blade pad element comprises a single piece; this term does not exclude the element in question itself being made up from a plurality of independent parts that are assembled together, as can be seen from the above description.

What is claimed is:

1. A knapsack comprising:

a bag;

a one-piece shoulder-blade pad element comprising firstly a reinforcing plate having a central zone and two side zones which extend the central zone sideways symmetrically about the midplane of the knapsack, and secondly two shoulder-blade pads placed in the two side zones on the reinforcing plate and shaped to bear against the shoulder blades of the user; and two shoulder straps connecting the two shoulder-blade pads to the bag, wherein the reinforcing plate is secured to the back of the knapsack solely via the reinforcing plate central zone in the top middle portion of the back.

2. A knapsack according to claim 1, characterized in that the reinforcing plate is slightly curved so that the side zones are slightly spaced apart from the back of the knapsack when in use.

3. A knapsack according to claim 1, characterized in that the reinforcing plate is made of a rigid or semi-rigid material which is covered in the two side zones in an aerated and damping material constituting the padding of the shoulder-blade pads.

4. A knapsack according to claim 3, characterized in that the reinforcing plate is made of high density foam which is covered in the two side zones by medium density foam and by porous foam that allows air to flow.

5. A knapsack according to claim 1, characterized in that the connection between the one-piece shoulder-blade pad element and the back of the knapsack is provided with the ability to allow the one-piece element to pivot to a certain extent relative to said back about an axis perpendicular to said back.

6. A knapsack according to claim 5, characterized in that the central zone is rectangular in shape having a short side of about 4 cm to 6 cm across the width of the knapsack and a long side of about 8 cm to 12 cm along the height of the knapsack.

7. A knapsack according to claim 5, characterized in that the back of the knapsack is made of flexible material and the central zone is fixed to said flexible material in a fixing zone, the ability to pivot being obtained by the ability of said material to deform about said connection zone.

8. A knapsack according to claim 7, characterized in that the central zone is secured to the flexible material by stitches.

9. A knapsack according to claim 8, characterized in that the central zone is rectangular in shape having a short side of about 4 cm to 6 cm across the width of the knapsack and a long side of about 8 cm to 12 cm along the height of the knapsack.

10. A knapsack according to claim 8, characterized in that:

the back of the knapsack has at least one stiffening element at a short distance (d) above the connection zone;

the stiffening element is constituted by a strap sewn transversely to the flexible material forming the back of the knapsack at a distance (d) equal to about 1 cm;

the reinforcing plate is slightly curved so that the side zones are slightly spaced apart from the back of the knapsack when in use;

the reinforcing plate is made of a rigid or semi-rigid material which is covered in the two side zones in an aerated and damping material constituting the padding of the shoulder-blade pads; and the reinforcing plate is made of high density foam which is covered in the two side zones by medium density foam and by porous foam that allows air to flow.

11. A knapsack according to claim 7, characterized in that first and second fastening means are provided respectively on the flexible material and on the central zone so as to secure the one-piece shoulder-blade pad element to the back of the knapsack by co-operating.

12. A knapsack according to claim 11, characterized in that the first and second fastening means are provided with self-fastening mechanical attachment elements comprising hooks and loops.

13. A knapsack according to claim 11, characterized in that the back of the knapsack has at least one stiffening element at a short distance (d) above the connection zone.

14. A knapsack according to claim 13, characterized in that the stiffening element is constituted by a strap sewn transversely to the flexible material forming the back of the knapsack at a distance (d) equal to about 1 cm.

* * * * *